US010842249B2

(12) United States Patent
Vasquez et al.

(10) Patent No.: US 10,842,249 B2
(45) Date of Patent: Nov. 24, 2020

(54) QUICK ATTACHMENT CARRIER ASSEMBLY OF A CONTAINER TO ENABLE FREE MOVEMENT OF A BODY OF A WEARER AND HANDS-FREE UTILIZATION THROUGH MULTIPLE ATTACHABILITY OPTIONS

(71) Applicants: Robert Vasquez, Gilbert, AZ (US); Brian Freeland, Chandler, AZ (US)

(72) Inventors: Robert Vasquez, Gilbert, AZ (US); Brian Freeland, Chandler, AZ (US)

(73) Assignee: SHAWSHANK LEDZ INC., Gilbert, AZ (US)

( * ) Notice: Subject to any disclaimer, the term of this patent is extended or adjusted under 35 U.S.C. 154(b) by 0 days.

(21) Appl. No.: 16/378,591

(22) Filed: Apr. 9, 2019

(65) Prior Publication Data

US 2020/0260847 A1 Aug. 20, 2020

Related U.S. Application Data

(60) Provisional application No. 62/805,316, filed on Feb. 14, 2019.

(51) Int. Cl.
*A45F 3/04* (2006.01)
*A45F 3/14* (2006.01)
(Continued)

(52) U.S. Cl.
CPC ..... *A45F 5/00* (2013.01); *A45F 3/005* (2013.01); *A45F 3/047* (2013.01); *A45F 3/14* (2013.01);
(Continued)

(58) Field of Classification Search
CPC ..... A45F 2005/008; A45F 2200/0516; A45F 5/021; A45C 2011/002; Y10S 224/93; Y10S 224/904; Y10T 24/1368
See application file for complete search history.

(56) References Cited

U.S. PATENT DOCUMENTS 4,570,688 A * 2/1986 Williams ..... A45C 1/04 150/102
4,705,086 A 11/1987 O'Neill
(Continued)

FOREIGN PATENT DOCUMENTS

WO 2017177255 A1 10/2017

*Primary Examiner* — Brian D Nash
(74) *Attorney, Agent, or Firm* — Legalforce RAPC Worldwide

(57) ABSTRACT

Disclosed are an apparatus and/or a method of a quick attachment carrier assembly of a container to enable free movement of a body of a wearer and hands-free utilization through multiple attachability options. In one aspect, a carrier attachment assembly includes an elongated flap, a first elastic band, and a second elastic band. The elongated flap has a proximal end and a distal end. The distal end of the elongated flap fits between a waist of a wearer and a waistband of a garment being worn by the wearer. The elongated flap is movable inside and/or outside the first elastic band and the second elastic band when the wearer manipulates the elastic bands and/or the elongated flap. The elongated flap is moved outside and/or inside to attach the container coupled with the carrier attachment assembly on the waist and/or the arm of the wearer respectively.

13 Claims, 7 Drawing Sheets

(51) Int. Cl.
*A45F 5/00* (2006.01)
*A45F 3/00* (2006.01)

(52) U.S. Cl.
CPC ... *A45F 2003/142* (2013.01); *A45F 2005/008* (2013.01); *A45F 2200/0516* (2013.01); *A45F 2200/0541* (2013.01); *A45F 2200/0558* (2013.01); *A45F 2200/0575* (2013.01); *A45F 2200/0583* (2013.01)

(56) References Cited

U.S. PATENT DOCUMENTS 4,815,510 A * 3/1989 Edelist ..... A45C 1/04 150/134
5,711,469 A * 1/1998 Gormley ..... A45F 5/02 224/236
5,749,841 A * 5/1998 Moore ..... A41D 13/088 602/20
6,209,769 B1 * 4/2001 Seals ..... A45C 1/04 224/583
6,244,486 B1 6/2001 Holland et al.
6,286,736 B1 9/2001 Angus et al.
6,360,928 B1 * 3/2002 Russo ..... A45F 5/00 224/218
6,364,187 B1 * 4/2002 Castellano ..... A45F 5/02 224/236
6,519,207 B1 * 2/2003 Lukacsko ..... A41D 19/0027 2/160
6,695,022 B2 2/2004 Morehead
6,729,518 B2 5/2004 Badillo et al.
6,889,879 B2 5/2005 Rivera et al.
7,296,752 B2 * 11/2007 Carnevali ..... G06F 1/163 235/462.43
7,334,711 B1 * 2/2008 Winters ..... A45F 5/00 224/217
8,196,787 B2 * 6/2012 Strandberg ..... A45F 5/00 2/16
D673,162 S * 12/2012 Young ..... D14/447
8,604,931 B1 * 12/2013 Veloso ..... H04M 1/72577 340/5.31
8,662,362 B1 * 3/2014 Bastian ..... H04B 1/3888 224/197
8,915,360 B2 12/2014 Oliver
9,198,498 B2 12/2015 Stevens, IV
9,351,551 B2 * 5/2016 Morgan ..... A45C 11/00
9,392,863 B2 7/2016 Hamilton
9,510,655 B2 12/2016 Stratton
10,244,862 B2 4/2019 Gallup et al.
2004/0020959 A1 2/2004 Sellars
2004/0134954 A1 7/2004 Myron
2004/0206791 A1 10/2004 Rogers
2007/0163904 A1 7/2007 Martin et al.
2008/0047990 A1 2/2008 Morgan et al.
2008/0149679 A1 3/2008 Case et al.
2008/0223892 A1 9/2008 Hamilton
2009/0014105 A1 1/2009 Shattuck
2009/0127304 A1 5/2009 Uygur
2009/0321483 A1 * 12/2009 Froloff ..... A45F 5/00 224/267
2014/0312083 A1 10/2014 Scott
2015/0318885 A1 * 11/2015 Earle ..... H04B 1/385 455/575.6

* cited by examiner

QUICK ATTACHMENT CARRIER ASSEMBLY OF A CONTAINER TO ENABLE FREE MOVEMENT OF A BODY OF A WEARER AND HANDS-FREE UTILIZATION THROUGH MULTIPLE ATTACHABILITY OPTIONS

CLAIM OF PRIORITY

This application is a Non-Provisional application of and claims priority to, and incorporates herein by reference the entire specification of the U.S. Provisional Application No. 62/805,316 titled QUICK ATTACHMENT CARRIER ASSEMBLY OF A POUCH TO ENABLE FREE MOVEMENT OF A BODY OF A WEARER AND HANDS FREE UTILIZATION THROUGH MULTIPLE ATTACHABILITY OPTIONS, filed on Feb. 14, 2019.

FIELD OF TECHNOLOGY

This disclosure relates generally to a container attachment mechanism and, more particularly, to an apparatus and/or a method of a quick attachment carrier assembly of a container to enable free movement of a body of a wearer and hands-free utilization through multiple attachability options.

BACKGROUND

A form-fitting garment, such as an athletic apparel (e.g., yoga pants and/or workout shorts) may be designed to tightly cling to a human body of a wearer while at the same time providing an ability to easily move about while performing physical exercises. The form-fitting garment may be designed to permit movement such as bending and stretching without impeding movement of the human body of the wearer. To streamline a physical appearance and overall comfort of the form-fitting garment, the form-fitting cloth may not have any pockets to carry valuable items. Even when pockets are present, storing items in pockets may restrict the free and comfortable movement of the human body of the wearer. Furthermore, people may hesitate to attach anything to their athletic apparel to avoid the risk of damage to the fabric of an expensive piece of clothing.

There may be a need of carrying valuable items such as a mobile device, a set of keys, a headphone, machine readable cards and the like while performing indoor and/or outdoor activities and while wearing the form-fitting garment. Because of the limitations of the form-fitting garments the valuable items may need to be carried in the hands of the wearer while performing activities when the form-fitting garment is worn. However, carrying the valuable items in hands while performing daily activities may create a risk of the valuable items falling and/or being misplaced. Further, putting the valuable belongings on a key rack and/or in a locker while performing outdoor activity may create a risk of the valuable belongings being stolen. In the case of some outdoor activities such as hiking and/or biking, carrying belongings in hands may become a safety hazard as using both hands is important while hiking a mountain and/or operating a bicycle.

Further, handling the valuable items in hands may result in perspiration damaging the valuable items (e.g., if susceptible to water damage). In such instances, the wearer of the form-fitting garment may need to expend hundreds of dollars to repair, replace lost and/or broken valuable items. In addition, carrying the valuable items by hand while wearing the form-fitting garment may restrict movement and/or effectiveness of physical exercise for the wearer. Options such as backpacks and waist-packs may be bulky and lead to scratches and rashes on the wearer's body, may impede the user's activity, may be unsightly, and may cause tearing and damage to the form-fitting apparel. Therefore, the wearer of the form-fitting garment may go without carrying valuable items altogether. This may cause the wearer to miss valuable meetings, appointment, and phone calls.

SUMMARY

Disclosed are an apparatus and/or a method of a quick attachment carrier assembly of a container to enable free movement of a body of a wearer and hands-free utilization through multiple attachability options.

In one aspect, a carrier attachment assembly includes an elongated flap, a first elastic band, and a second elastic band. The elongated flap has a length between 3 inches and 8 inches. The elongated flap has a proximal end and a distal end. The proximal end of the elongated flap is attachable to a container coupled with the carrier attachment assembly. The distal end of the elongated flap is curved in a manner to fit between a waist of a wearer and a waistband of a garment being worn by the wearer.

The first elastic band is positioned at an upper-left corner of the carrier attachment assembly to extend across the elongated flap to a lower-right corner of the carrier attachment assembly. In addition, the second elastic band is positioned at an upper-right corner of the carrier attachment assembly to extend across the elongated flap to a lower-left corner of the carrier attachment assembly.

The first elastic band and the second elastic band forms an 'X' shape over the elongated flap when the container is positioned in an arm attachment position on an arm of the wearer. Further, the first elastic band and the second elastic band form an 'X' shape under the elongated flap when the container is positioned in a waist attachment position on the waist of the wearer.

The elongated flap is movable outside the first elastic band and the second elastic band when the wearer manipulates the first elastic band, the second elastic band, and/or the elongated flap. The elongated flap is moved outside the first elastic band and the second elastic band to attach the container coupled with the carrier attachment assembly on the waist of the wearer. In addition, the elongated flap is movable inside the first elastic band and the second elastic band when the wearer manipulates the first elastic band, the second elastic band, and/or the elongated flap. The elongated flap is moved inside the first elastic band and the second elastic band to attach the container coupled with the carrier attachment assembly on the arm of the wearer.

The container may be detachable from the carrier attachment assembly. The container and the carrier attachment assembly may be inseparable. The container may be a small carrying case, a smartphone carrier, a rigid container, a flexible container, an item retainer, a mini-purse, a key-holder, a bottle, a liquid holder, a medicine holder, a tool holder, a reading glasses and sunglasses case, a plastic container, a bag, and/or a mini-pack. The mini-pack may imitate a physical form of a backpack. The smartphone carrier form of the container may include a first port opening to permit a headphone jack to be exposed. The smartphone carrier form of the container may enable the wearer to couple a headphone to a smartphone inside the smartphone carrier.

Further, the smartphone carrier form of the container may include a second port opening to permit a charging port to be exposed. The smartphone carrier form of the container may enable the wearer to couple a charging cable to the smartphone inside the smartphone carrier. The smartphone carrier form of the container may include a storage space for a portable charger and/or a battery.

In another aspect, a carrier pouch includes a pouch section and a carrier attachment assembly. The carrier attachment assembly is coupled with the pouch section of a length approximately 3 to 9 inches. The carrier attachment assembly enables a wearer to carry the carrier pouch with hands-free mobility. The carrier attachment assembly includes a rigid assembly, a plurality of elastic bands, and a loop strap. A distal end of the rigid assembly is a curved, a triangular, and/or a hexagonal in a manner to comfortably tuck in an inner side of a waistband of a garment.

The plurality of elastic bands extends across and over the rigid assembly when the carrier attachment assembly coupled with the pouch section is positioned on a limb of the wearer. In addition, the plurality of elastic bands extends across and under the rigid assembly when the carrier attachment assembly coupled with the pouch section is positioned on the waistband of the wearer's garment. The loop strap of the carrier attachment assembly holds small articles.

The rigid assembly may have a length between 3 inches and 8 inches. The rigid assembly may be moved inside and/or outside of the plurality of elastic bands when the elastic bands and/or the rigid assembly are manipulated. The rigid assembly may be moved inside of the plurality of elastic bands to position the carrier pouch coupled with the carrier attachment assembly on the limb of the wearer. Further, the rigid assembly may be moved outside of the plurality of elastic bands to position the carrier pouch coupled with the carrier attachment assembly on the waistband of the wearer's garment.

The plurality of elastic bands may be made of 20% chinlon and 80% spandex. The plurality of elastic bands may be stretched elastically to position the carrier pouch onto the wearer's limb. The plurality of elastic bands may provide a comfortable fit to adjust to different sizes of the wearer's limb.

In yet another aspect, a method of a carrier attachment assembly coupled with a container to tuck in an inner side of a garment of a wearer includes manipulating a first elastic band and/or a second elastic band of the carrier attachment assembly to enable a free movement of an elongated flap from a distal end. The method of the carrier attachment assembly includes extracting the elongated flap of the carrier attachment assembly in an outward direction.

The method of the carrier attachment assembly further includes outstretching a waistband of the garment worn by the wearer to position the container on a waist attachment position of the wearer. The method of the carrier attachment assembly includes tuck the elongated flap in the inner side of the garment to enable the wearer to access the container. In addition, the method of the carrier attachment assembly includes releasing the waistband to hold the elongated flap of the carrier attachment assembly to fit in the inner side of the garment to hold the container onto the garment.

The method of the carrier attachment assembly may further include manipulating the first elastic band and/or the second elastic band of the carrier attachment assembly to position the elongated flap under the first elastic band and the second elastic band. The method of the carrier attachment assembly may include moving the elongated flap behind the first elastic band and the second elastic band. In addition, the method of the carrier attachment assembly may include manipulating the first elastic band and the second elastic band of the carrier attachment assembly to enable the wearer to insert the hand. The method of the carrier attachment assembly may include positioning the carrier attachment assembly coupled with the container onto an arm attachment position to comfortably fit to adjust based on the size of the wearer's arm.

In a further aspect, a container includes a retainment section and an elongated flap. The elongated flap has a proximal end coupled with the retainment section. The elongated flap coupled with the retainment section enables a wearer to carry the container without having to hold the container in a hand of the wearer. A distal end of the elongated flap is a curved, a triangular, and/or a hexagonal in a manner to comfortably tuck in an inner side of a waistband of a garment.

In yet further aspect, an elongated flap of the carrier attachment assembly may be tucked on an elastic strap of the wearer's garment. The elastic strap of the wearer's garment may be on the upper wear and/or the bottom wear garment. The elongated flap may securely fit in an inner side of the elastic strap of the wearer's garment to enable the wearer to carry the container along with hands-free mobility.

In one more further aspect, an elongated flap of the carrier attachment assembly may have a first magnetic element on the elongated flap to magnetically attach with a second magnetic element positioned at a matching position of the carrier attachment assembly. The first magnetic element and the second magnetic element may be able to create a magnetic contact through the wearer's garment. The magnetic contact of the first magnetic element and the second magnetic element may enable the elongated flap to securely fit in an inner side of the wearer's garment when the elongated flap is tucked in an inner side of the wearer's garment.

In furthermore aspect, the carrier attachment assembly may have an elongated flap without any elastic band to securely fit in the inner side of the wearer's garment when the elongated flap is tucked in an inner side of the wearer's garment.

The methods and systems disclosed herein may be implemented in any means for achieving various aspects, and may be executed in a form of a non-transitory machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Figure 1:
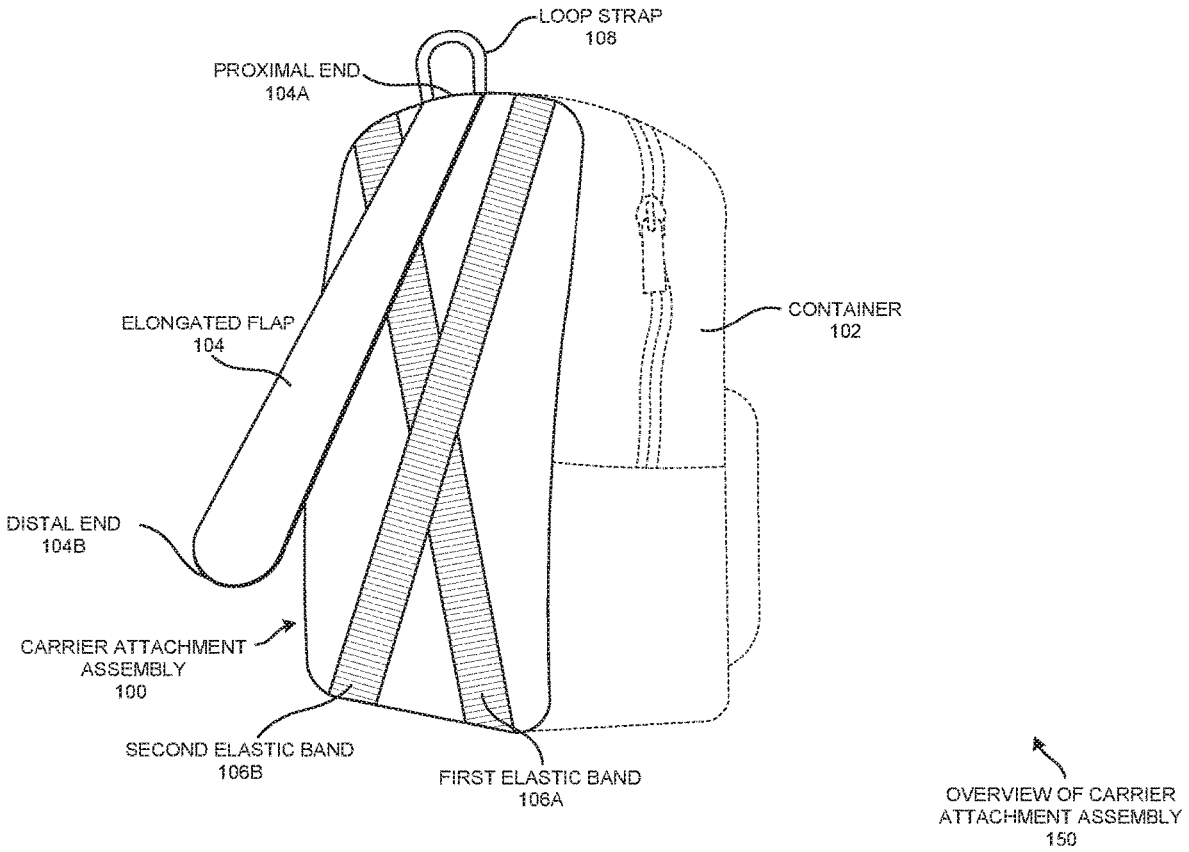
FIG. 1 is an overview of a carrier attachment assembly coupled with a container illustrating an elongated flap and the elastic bands of the carrier attachment assembly for attachment means, according to one embodiment.

Other features of the present embodiments will be apparent from the accompanying drawings and from the detailed description that follows.

DETAILED DESCRIPTION

Disclosed are an apparatus and/or a method of a quick attachment carrier assembly 100 of a container 102 to enable free movement of a body of a wearer 200 and hands-free utilization through multiple attachability options. In one embodiment, a carrier attachment assembly 100 includes an elongated flap 104, a first elastic band 106A, and a second elastic band 106B. The elongated flap 104 has a length between 3 inches and 8 inches. The elongated flap 104 has a proximal end 104A and a distal end 104B. The proximal end 104A of the elongated flap 104 is attachable to a container 102 coupled with the carrier attachment assembly 100. The distal end 104B of the elongated flap 104 is curved in a manner to fit between a waist of a wearer 200 and a waistband 204 of a garment 202 being worn by the wearer 200.

The first elastic band 106A is positioned at an upper-left corner the carrier attachment assembly 100 to extend across the elongated flap 104 to a lower-right corner of the carrier attachment assembly 100. In addition, the second elastic band 106B is positioned at an upper-right corner of the carrier attachment assembly 100 to extend across the elongated flap 104 to a lower-left corner of the carrier attachment assembly 100.

The first elastic band 106A and the second elastic band 106B forms an 'X' shape over the elongated flap 104 when the container 102 is positioned in an arm attachment position on an arm 201 of the wearer 200. Further, the first elastic band 106A and the second elastic band 106B form an 'X' shape under the elongated flap 104 when the container 102 is positioned in a waist attachment position on the waist of the wearer 200.

The elongated flap 104 is movable outside the first elastic band 106A and the second elastic band 106B when the wearer 200 manipulates the first elastic band 106A, the second elastic band 106B, and/or the elongated flap 104. The elongated flap 104 is moved outside the first elastic band 106A and the second elastic band 106B to attach the container 102 coupled with the carrier attachment assembly 100 on the waist of the wearer 200. In addition, the elongated flap 104 is movable inside the first elastic band 106A and the second elastic band 106B when the wearer 200 manipulates the first elastic band 106A, the second elastic band 106B, and/or the elongated flap 104. The elongated flap 104 is moved inside the first elastic band 106A and the second elastic band 106B to attach the container 102 coupled with the carrier attachment assembly 100 on the arm 201 of the wearer 200.

The container 102 may be detachable from the carrier attachment assembly 100. The container 102 and the carrier attachment assembly 100 may be inseparable. The container 102 may be a small carrying case, a smartphone carrier, a rigid container, a flexible container, an item retainer, a mini-purse, a keyholder, a bottle, a liquid holder, a medicine holder, a tool holder, a reading glasses and sunglasses case, a plastic container, a bag, and/or a mini-pack. The mini-pack (e.g., form of container 102) may imitate a physical form of a backpack. The smartphone carrier form of the container 102 may include a first port opening (e.g., port opening 206) to permit a headphone jack to be exposed. The smartphone carrier form of the container 102 may enable the wearer 200 to couple a headphone to a smartphone inside the smartphone carrier.

Further, the smartphone carrier form of the container 102 may include a second port opening (e.g., port opening 206) to permit a charging port to be exposed. The smartphone carrier form of the container 102 may enable the wearer 200 to couple a charging cable to the smartphone inside the smartphone carrier. The smartphone carrier form of the container 102 may include a storage space for a portable charger and/or a battery.

In another embodiment, a carrier pouch (e.g., container 102) includes a pouch section (e.g., retainment section) and a carrier attachment assembly 100. The carrier attachment assembly 100 is coupled with the pouch section (of container 102) of a length approximately 3 to 9 inches. The carrier attachment assembly 100 enables a wearer 200 to carry the carrier pouch (e.g., container 102) with hands-free mobility. The carrier attachment assembly 100 includes a rigid assembly (e.g., elongated flap 104), a plurality of elastic bands (e.g., first elastic band 106A, and second elastic band 106B), and a loop strap 108. A distal end 104B of the rigid assembly (e.g., elongated flap 104) is a curved, a triangular, and/or a hexagonal in a manner to comfortably tuck in an inner side of a waistband 204 of a garment 202.

The plurality of elastic bands (e.g., first elastic band 106A, and second elastic band 106B) extend across and over the rigid assembly (e.g., elongated flap 104) when the carrier attachment assembly 100 coupled with the pouch section (of container 102) is positioned on a limb (e.g., arm 201) of the wearer 200. In addition, the plurality of elastic bands (e.g., first elastic band 106A, and second elastic band 106B) extend across and under the rigid assembly (e.g., elongated flap 104) when the carrier attachment assembly 100 is coupled with the pouch section (of container 102) positioned on the waistband 204 of the wearer's garment 202. The loop strap 108 of the carrier attachment assembly 100 holds small articles.

The rigid assembly (e.g., elongated flap 104) may have a length between 3 inches and 8 inches. The rigid assembly (e.g., elongated flap 104) may be moved inside and/or outside of the plurality of elastic bands (e.g., first elastic band 106A, and second elastic band 106B) when the elastic bands (e.g., first elastic band 106A, and second elastic band 106B) and/or the rigid assembly (e.g., elongated flap 104) are manipulated. The rigid assembly (e.g., elongated flap 104) may be moved inside of the plurality of elastic bands (e.g., first elastic band 106A, and second elastic band 106B) to position the carrier pouch (e.g., container 102) coupled with the carrier attachment assembly 100 on the limb (e.g., arm 201) of the wearer 200. Further, the rigid assembly (e.g., elongated flap 104) may be moved outside of the plurality of elastic bands (e.g., first elastic band 106A, and second elastic band 106B) to position the carrier pouch (e.g., container 102) coupled with the carrier attachment assembly 100 on the waistband 204 of the wearer's garment 202.

The plurality of elastic bands (e.g., first elastic band 106A, and second elastic band 106B) may be made of 20% chinlon and 80% spandex. The plurality of elastic bands (e.g., first elastic band 106A, and second elastic band 106B) may be stretched elastically to position the carrier pouch (e.g., container 102) onto the wearer's limb (e.g., arm 201). The plurality of elastic bands (e.g., first elastic band 106A, and second elastic band 106B) may provide a comfortable fit to adjust based on different sizes of the wearer's limb (e.g., arm 201).

In yet another embodiment, a method of a carrier attachment assembly 100 coupled with a container 102 to tuck in an inner side of a garment 202 of a wearer 200 includes manipulating a first elastic band 106A and/or a second elastic band 106B of the carrier attachment assembly 100 to enable a free movement of an elongated flap 104 from a distal end 104B. The method of the carrier attachment assembly 100 includes extracting the elongated flap 104 of the carrier attachment assembly 100 in an outward direction.

The method of the carrier attachment assembly 100 further includes outstretching a waistband 204 of the garment 202 worn by the wearer 200 to position the container 102 on a waist attachment position of the wearer 200. The method of the carrier attachment assembly 100 includes tuck the elongated flap 104 in the inner side of the garment 202 to enable the wearer 200 to access the container 102. In addition, the method of the carrier attachment assembly 100 includes releasing the waistband 204 to hold the elongated flap 104 of the carrier attachment assembly 100 to fit in the inner side of the garment 202 to hold the container 102 onto the garment 202.

The method of the carrier attachment assembly 100 may further include manipulating the first elastic band 106A and/or the second elastic band 106B of the carrier attachment assembly 100 to position the elongated flap 104 under the first elastic band 106A and the second elastic band 106B. The method of the carrier attachment assembly 100 may include moving the elongated flap 104 behind the first elastic band 106A and the second elastic band 106B. In addition, the method of the carrier attachment assembly 100 may include manipulating the first elastic band 106A and the second elastic band 106B of the carrier attachment assembly 100 to enable the wearer 200 to insert the hand. The method of the carrier attachment assembly 100 may include positioning the carrier attachment assembly 100 coupled with the container 102 onto an arm attachment position (e.g., on the arm 201) to comfortably fit to adjust based on the size of the wearer's arm 201.

In a further aspect, a container 102 includes a retainment section and an elongated flap 104. The elongated flap 104 has a proximal end 104A coupled with the retainment section (of container 100). The elongated flap 104 coupled with the retainment section (of container 100) enables a wearer 200 to carry the container 100 without having to hold the container 100 in a hand of the wearer 200. A distal end 104B of the elongated flap 104 is a curved, a triangular, and/or a hexagonal in a manner to comfortably tuck in an inner side of a waistband 204 of a garment 202.

In yet a further embodiment, an elongated flap 104 of the carrier attachment assembly 100 may be tucked on an elastic strap (e.g., waistband 204) of the wearer's garment 202. The elastic strap of the wearer's garment 202 may be on the upper wear and/or the bottom wear garment 202. The elongated flap 104 may securely fit in an inner side of the elastic strap (e.g., waistband 204) of the wearer's garment 202 to enable the wearer 200 to carry the container 102 along with hands-free mobility.

In one more further embodiment, an elongated flap 104 of the carrier attachment assembly 100 may have a first magnetic element on the elongated flap 104 to magnetically attach with a second magnetic element positioned at a matching position of the carrier attachment assembly 100. The first magnetic element and the second magnetic element may be able to create a magnetic contact through the wearer's garment 202. The magnetic contact of the first magnetic element and the second magnetic element may enable the elongated flap 104 to securely fit in an inner side of the wearer's garment 202 when the elongated flap 104 is tucked inside of the wearer's garment 202.

In furthermore embodiment, the carrier attachment assembly 100 may have an elongated flap 104 without any elastic band (e.g., first elastic band 106A, and second elastic band 106B) to securely fit inside of the wearer's garment 202 when the elongated flap 104 is tucked in an inner side of the wearer's garment 202.

FIG. 1 is an overview of a carrier attachment assembly 150 coupled with a container 102 illustrating an elongated flap 104 and the elastic bands (e.g., first elastic band 106A and second elastic band 106B) of the carrier attachment assembly 100 for attachment means, according to one embodiment. Particularly, FIG. 1 illustrates a carrier attachment assembly 100, a container 102, an elongated flap 104, a proximal end 104A, a distal end 104B, a first elastic band 106A, a second elastic band 106B, and a loop strap 108, according to one embodiment.

The carrier attachment assembly 100 may be a fastening mechanism coupled with the container 102 to enable the wearer 200 to carry the container 102 on the garment 202 and/or the arm 201 (e.g., limb) of the wearer 200. The carrier attachment assembly 100 coupled with the container 102 may provide instant access to the articles in the container 102 to the wearer 200. The carrier attachment assembly 100 coupled with the container 102 may enable the wearer 200 to carry the container 102 with unrestricted user mobility. The carrier attachment assembly 100 coupled with the container 102 may enable the wearer 200 to perform indoor and/or outdoor activities hands-free. The carrier attachment assembly 100 may be detachable from the container 102, according to one embodiment.

The attachment and/or removal of the carrier attachment assembly 100 may be quick and convenient for the wearer 200. The carrier attachment assembly 100 and the container 102 may be inseparable. The carrier attachment assembly 100 may include the elongated flap 104, a plurality of elastic bands (e.g., the first elastic band 106A, the second elastic band 106B) and the loop strap 108. The carrier attachment assembly 100 coupled with the container 102 may be tucked in an inner side of (e.g., or underneath) the wearer's garment 202 and/or securely positioned on the arm 201 (e.g., limb) of the wearer 200, according to one embodiment.

The container 102 may be a small bag to encompass a plurality of valuable items having a flexible and/or a rigid construction, to carry with hands-free mobility. The container 102 may include a retainment section (e.g., pouch section) and the carrier attachment assembly 100. The container 102 may be coupled with the carrier attachment assembly 100 to provide instant access to the articles in the container 102 to the wearer 200. The container 102 may be quickly tucked in the inner side of the wearer's garment 202 and/or securely position on the arm 201 (e.g., limb) of the wearer 200. The container 102 may be carried on the garment 202 and/or the arm 201 (e.g., limb) of the wearer 200 with unrestricted mobility. The container 102 may have a length of approximately 3 to 9 inches, according to one embodiment.

The container 102 may be detachable from the carrier attachment assembly 100. The method of attachment and/or detachment of the container 102 and the carrier attachment assembly 100 may be magnetic, using hook and loop and/or using buttons. In another embodiment, the container 102 and the carrier attachment assembly 100 may be inseparable. The container 102 may be a bottle, a plurality of rubber ring to carry a number of bottles, a tool holder, reading glasses and/or sunglasses case, and/or a plastic container. In addition, the container 102 may be a bag designed to hold a smartphone, a wallet, a set of glasses, a set of keys, an identification card, a machine readable card, a medicine, a first aid kit, a cosmetic, a food item, and/or a stationary product, according to one embodiment.

Further, the container 102 may include a plurality of openings (e.g., opening port 206) to permit a headphone jack and/or a charging port to be exposed. The container 102 may include a storage space for a portable charger and/or a battery, according to one embodiment.

The elongated flap 104 may be a flat strip made of a flexible-cushioned material to enable the carrier attachment assembly 100 coupled with the container 102 to securely fit in the inner side of the wearer's garment 202. The elongated flap 104 may have a length between 3 inches and 8 inches. The elongated flap 104 may be made of 90% regenerated leather and 10% suede material. The material of the elongated flap 104 may be comfortable against the wearer's 200 skin and/or garment 202 such that the elongated flap 104 does not harm wearer's 200 skin and/or garment 202, according to one embodiment.

The elongated flap 104 may include the proximal end 104A and the distal end 104B. The elongated flap 104 may be attachable to the carrier attachment assembly 100 from the proximal end 104A of the elongated flap 104 to enable the elongated flap 104 to freely move from the distal end 104B. The elongated flap 104 may be moved over and/or under the elastic bands (e.g., first elastic band 106A and second elastic band 106B) of the carrier attachment assembly 100 when the wearer 200 manipulates the first elastic band 106A, the second elastic band 106B, and/or the elongated flap 104, according to one embodiment.

The elongated flap 104 may be moved outside by manipulating the distal end 104B to attach the container 102 coupled with the carrier attachment assembly 100 on the waist of the wearer 200. The elongated flap 104 may be positioned over the elastic bands (e.g., first elastic band 106A and second elastic band 106B) when the container 102 coupled with the carrier attachment assembly 100 is in a waist attachment position on a waist of the wearer 200. The elongated flap 104 may be moved inside to position the container 102 coupled with the carrier attachment assembly 100 on the arm 201 (e.g., limb) of the wearer 200, according to one embodiment.

The elongated flap 104 may be positioned under the elastic bands (e.g., first elastic band 106A and second elastic band 106B) when the container 102 coupled with the carrier attachment assembly 100 in an arm attachment position on the arm 201 (e.g., limb) of the wearer 200. In another embodiment, the elongated flap 104 may be a rigid tab made of an inflexible material to enable the carrier attachment assembly 100 coupled with the container 102 to tuck in the inner side of the wearer's garment 202, according to one embodiment.

In yet another embodiment, the elongated flap 104 of the disclosed carrier attachment assembly 100 may have a first magnetic element on the elongated flap 104 to magnetically attach with a second magnetic element positioned at a matching position of the carrier attachment assembly 100. The first magnetic element and the second magnetic element may be able to create a magnetic contact through the wearer's garment 202. The magnetic contact of the first magnetic element and the second magnetic element may enable the elongated flap 104 to securely fit in the inner side of the wearer's garment 202 when the elongated flap 104 is tucked inside of (e.g., or underneath) the wearer's garment 202, according to one embodiment.

The proximal end 104A may be a first extremity of the elongated flap 104 attachable to the carrier attachment assembly 100 coupled with the container 102. The proximal end 104A of the elongated flap 104 may be fastened, stitched, sewn and/or stapled to the carrier attachment assembly 100 to enable the free movement of the elongated flap 104 from the distal end 104B, according to one embodiment.

The distal end 104B may be a second extremity of the elongated flap 104 to securely fit the elongated flap 104 of the carrier attachment assembly 100 in the inner side of the wearer's garment 202. The distal end 104B may have a curved, a hexagonal, and/or triangular shape to enable comfortable insertion of the elongated flap 104 in the inner side of the wearer's garment 202, according to one embodiment.

The first elastic band 106A and the second elastic band 106B may be thin interlacing strips of flexible material to stretch elastically and securely positioned the carrier attachment assembly 100 coupled with the container 102 onto the wearer's arm 201. The elastic bands (e.g., first elastic band 106A and second elastic band 106B) may be made of 20% chinlon and 80% spandex such that elastic bands (e.g., first elastic band 106A and second elastic band 106B) provide a comfortable fit by adjusting to different wearer's arm 201 size, according to one embodiment.

The first elastic band 106A of the carrier attachment assembly 100 may be positioned at an upper-left corner of the carrier attachment assembly 100 to a lower-right corner of the carrier attachment assembly 100. The second elastic band 106B of the disclosed carrier attachment assembly 100 may be positioned at an upper-right corner of the carrier attachment assembly 100 to a lower-left corner of the carrier attachment assembly 100. Both ends of the elastic bands (e.g., first elastic band 106A and second elastic band 106B) may be fastened, stitched, sewn and/or stapled to the carrier attachment assembly 100, according to one embodiment.

The first elastic band 106A and the second elastic band 106B of the carrier attachment assembly 100 may be manipulated by the wearer 200 to move the elongated flap 104 inside and/or outside from its position. The first elastic band 106A and the second elastic band 106B may form an 'X' shape over the elongated flap 104 when the container 102 coupled with the carrier attachment assembly 100 is in an arm attachment position on the arm 201 of the wearer 200. The first elastic band 106A and the second elastic band 106B may form an 'X' shape under the elongated flap 104 when the container 102 coupled with the carrier attachment assembly 100 is in the waist attachment position on the waist of the wearer 200, according to one embodiment.

In another embodiment, a plurality of elastic bands (e.g., first elastic band 106A and the second elastic band 106B) may be stretched to insert a wearer's limb (e.g., arm 201) to securely position a container 102 coupled with the carrier attachment assembly 100 onto the wearer's limb (e.g., arm 201) to hold the container 102 in place.

The loop strap 108 may be attached to the carrier attachment assembly 100 coupled with the container 102 to form a circular structure to enable the attachment of a plurality of items through it. The loop strap 108 may enable the container 102 coupled with the carrier attachment assembly 100 to hang on any hook element, according to one embodiment.

Figure 2A:
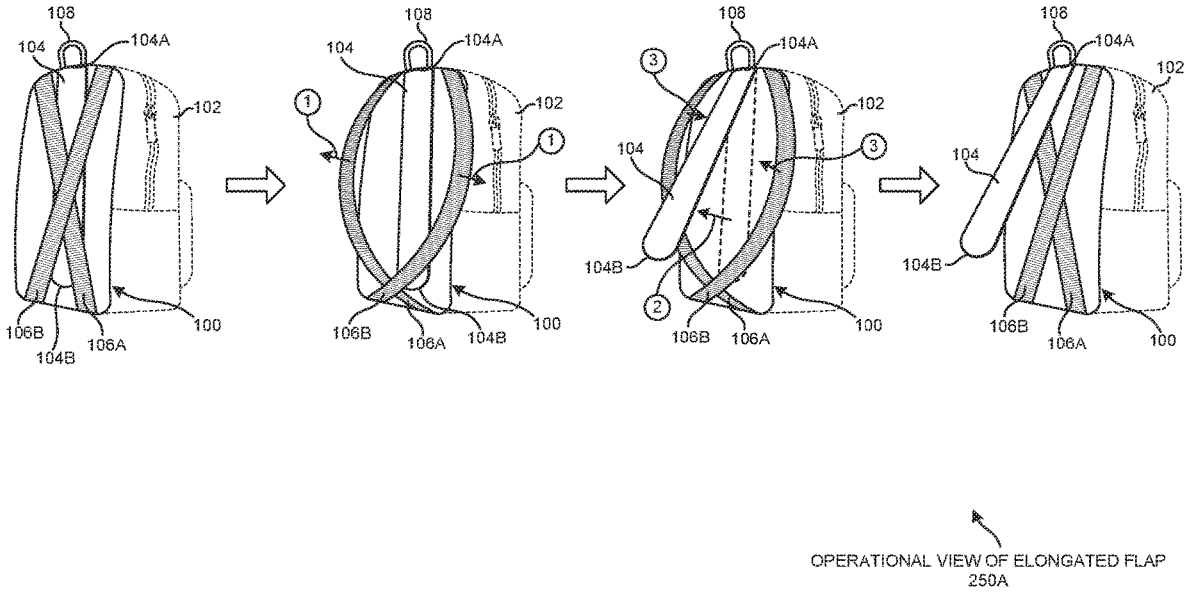
FIG. 2A is an operational view of the elongated flap of the carrier attachment assembly of FIG. 1 illustrating a sequential procedure to extract the elongated flap positioned behind the elastic bands of the carrier attachment assembly for attachment means, according to one embodiment.

FIG. 2A is an operational view of the elongated flap 250A of the carrier attachment assembly 100 of FIG. 1 illustrating a sequential procedure to extract the elongated flap 104 positioned behind the elastic bands (e.g., first elastic band 106A and second elastic band 106B) of the carrier attachment assembly 100 for attachment means, according to one embodiment.

FIG. 2A illustrates the number of operations between the elongated flap 104, the first elastic band 106A, and the second elastic band 106B of the carrier attachment assembly 100. Particularly, in circle '1' of FIG. 2A, the first elastic band 106A and the second elastic band 106B of the carrier attachment assembly 100 may be stretched to enable the elongated flap 104 to extract outside. In circle '2', the elongated flap 104 may be extracted outside (e.g., from distal end 104B) from its position. In circle '3', the first elastic band 106A and the second elastic band 106B may be released to its original position such that the first elastic band 106A and the second elastic band 106B form an 'X' shape under the elongated flap 104. The elongated flap 104 may be extracted outside to tuck the elongated flap 104 in the inner side of the wearer's garment 202 to enable the container 102 coupled with the carrier attachment assembly 100 to place in the waist attachment position on the waist of the wearer 200, according to one embodiment.

Figure 2B:
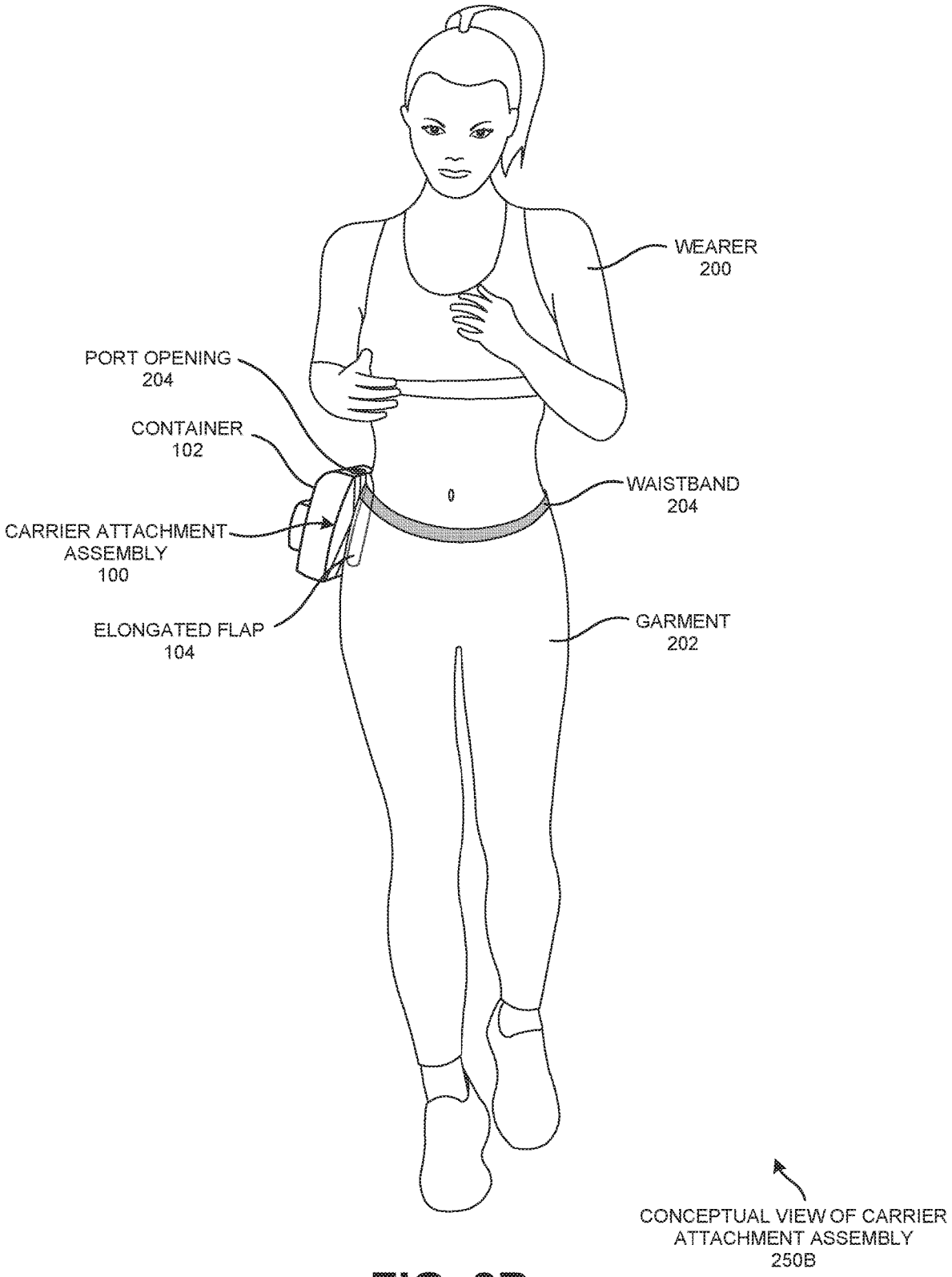
FIG. 2B is a conceptual view of the carrier attachment assembly of FIG. 1 coupled with the container to hold the elongated flap of the carrier attachment assembly in an inner side of the wearer's garment to provide instant access to the articles in the container, according to one embodiment.

FIG. 2B is a conceptual view of the carrier attachment assembly 250B of FIG. 1 coupled with the container 102 to hold the elongated flap 104 of the carrier attachment assembly 100 in an inner side of the wearer's garment 202 to provide instant access to the articles in the container 102, according to one embodiment. Particularly, FIG. 2B illustrates a wearer 200, an arm 201, a garment 202, a waistband 204, and a port opening 206, according to one embodiment.

The wearer 200 may be a person who wishes to carry a plurality of valuable items in the container 102 on the garment 202 and/or the arm 201. The wearer 200 may have instant access to the articles in the container 102 tucked in the inner side of the wearer's garment 202 and/or securely position on the arm 201 (e.g., limb) of the wearer 200. The wearer 200 may have instant access to the articles in the container 102 with unrestricted mobility. The wearer 200 may manipulate the first elastic band 106A, the second elastic band 106B, and/or the elongated flap 104 to move the elongated flap 104 over and/or under the elastic bands (e.g., first elastic band 106A and second elastic band 106B) based on a mode of attachment. The wearer's arm 201 may be in between the container 102 and the elastic bands (e.g., first elastic band 106A and second elastic band 106B) when the elongated flap 104 is pressed against the container 102 and the carrier attachment assembly 100 coupled with the container 102 is in the arm attachment position, according to one embodiment.

The garment 202 may be form-fitting apparel worn by the wearer 200. The garment 202 may not have adequate pockets to carry a plurality of valuable items. The garment 202 may have a waistband 204 to enable the container 102 coupled with the carrier attachment assembly 100 to tuck in the inner side of the wearer's garment 202 in the waist attachment position. The garment 202 may be upper wear and/or bottom wear garment. The waistband 204 of the garment 202 may be an elastic band encircling the wearer's 200 body to enable the elongated flap 104 to securely fit in the inner side of the wearer's garment 202. The waistband 204 of the garment 202 may enable the distal end 104B of the elongated flap 104 to comfortably insert to tuck the elongated flap 104 and hold in the inner side of the wearer's garment 202, according to one embodiment.

Figure 3A:
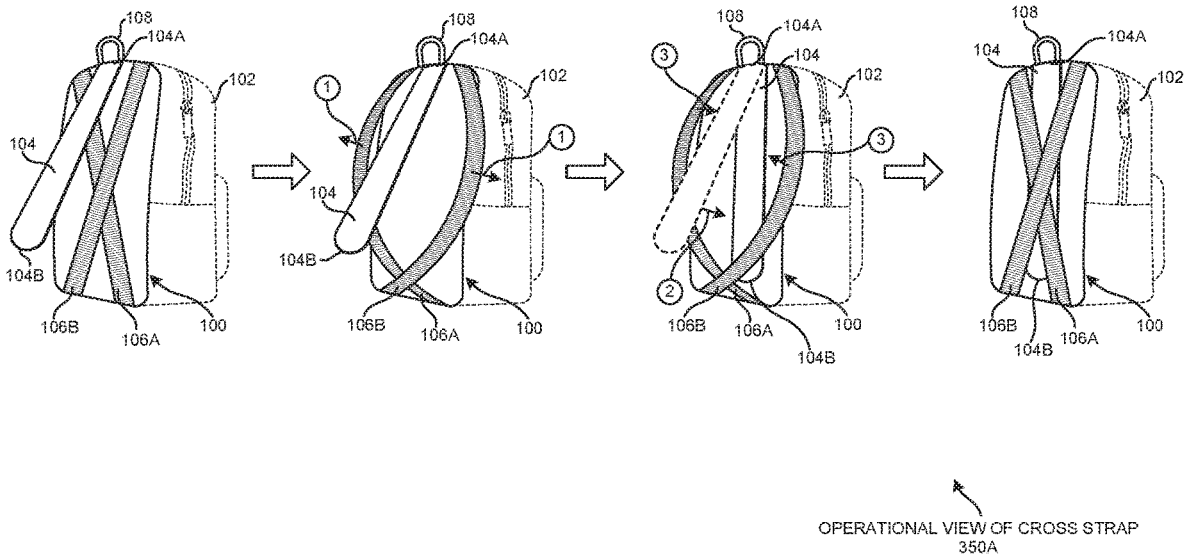
FIG. 3A is an operational view of the elastic bands of the carrier attachment assembly of FIG. 1 illustrating a sequential procedure to replace the elongated flap behind the elastic bands to enable holding of the container using the elastic bands, according to one embodiment.

FIG. 3A is an operational view of the elastic bands 350A of the carrier attachment assembly 100 of FIG. 1 illustrating a sequential procedure to replace the elongated flap 104 behind the elastic bands (e.g., first elastic band 106A and second elastic band 106B) to enable holding of the container 102 using the elastic bands (e.g., first elastic band 106A and second elastic band 106B), according to one embodiment.

FIG. 3A illustrates the number of operations between the elongated flap 104, the first elastic band 106A, and the second elastic band 106B of the carrier attachment assembly 100. Particularly, in circle '1' of FIG. 3A, the first elastic band 106A and the second elastic band 106B of the carrier attachment assembly 100 may be stretched to enable insertion of the elongated flap 104 under the elastic bands (e.g., first elastic band 106A and second elastic band 106B). In circle '2', the elongated flap 104 may be moved to the inside (e.g., from distal end 104B) to insert under the elastic bands (e.g., first elastic band 106A and second elastic band 106B), according to one embodiment.

In circle '3', the first elastic band 106A and the second elastic band 106B may be released to its original position such that the first elastic band 106A and the second elastic band 106B form an 'X' shape over the elongated flap 104. The elastic bands (e.g., first elastic band 106A and the second elastic band 106B) may be stretched-out to enable insertion of the wearer's arm 201 to securely position the container 102 coupled with the carrier attachment assembly 100 in the arm attachment position on the arm 201 of the wearer 200, according to one embodiment.

Figure 3B:
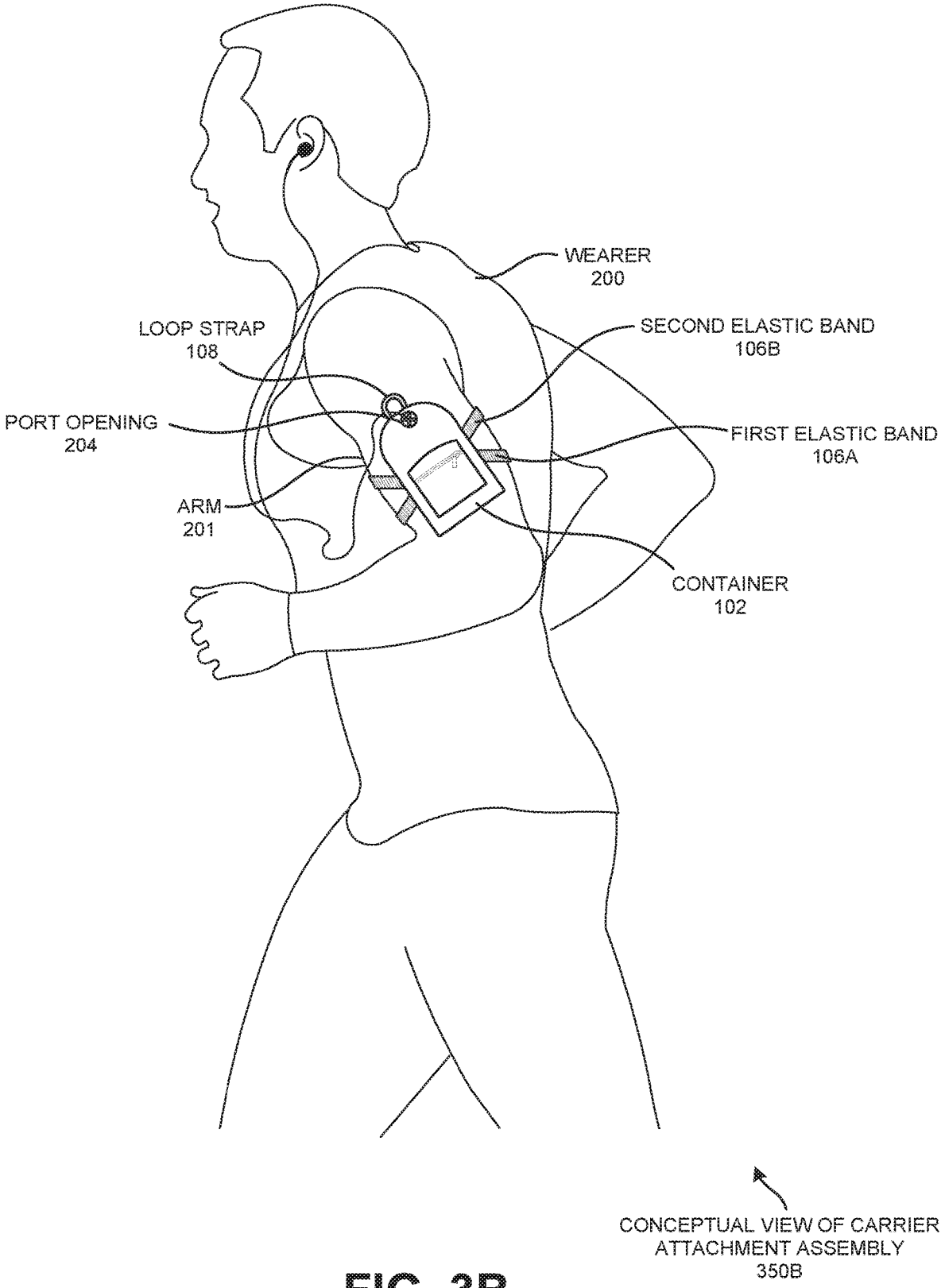
FIG. 3B is a conceptual view of the carrier attachment assembly of FIG. 1 coupled with the container to securely position onto the wearer's arm to provide instant access to the articles in the container, according to one embodiment.

FIG. 3B is a conceptual view of the carrier attachment assembly 350B of FIG. 1 coupled with the container 102 to securely position onto the wearer's arm 201 to provide instant access to the articles in the container 102, according to one embodiment.

FIG. 3B illustrates the wearer 200 carrying the container 102 coupled with the carrier attachment assembly 100 positioned onto the arm attachment position on the arm 201 of the wearer 200. The elastic bands (e.g., first elastic band 106A and the second elastic band 106B) may enable insertion of the wearer's arm 201 to securely position the container 102 onto the wearer's arm 201. The wearer 200 may have instant access to the articles in the container 102 securely positioned on the arm 201 of the wearer 200 with unrestricted mobility, according to one embodiment.

Figure 4A:
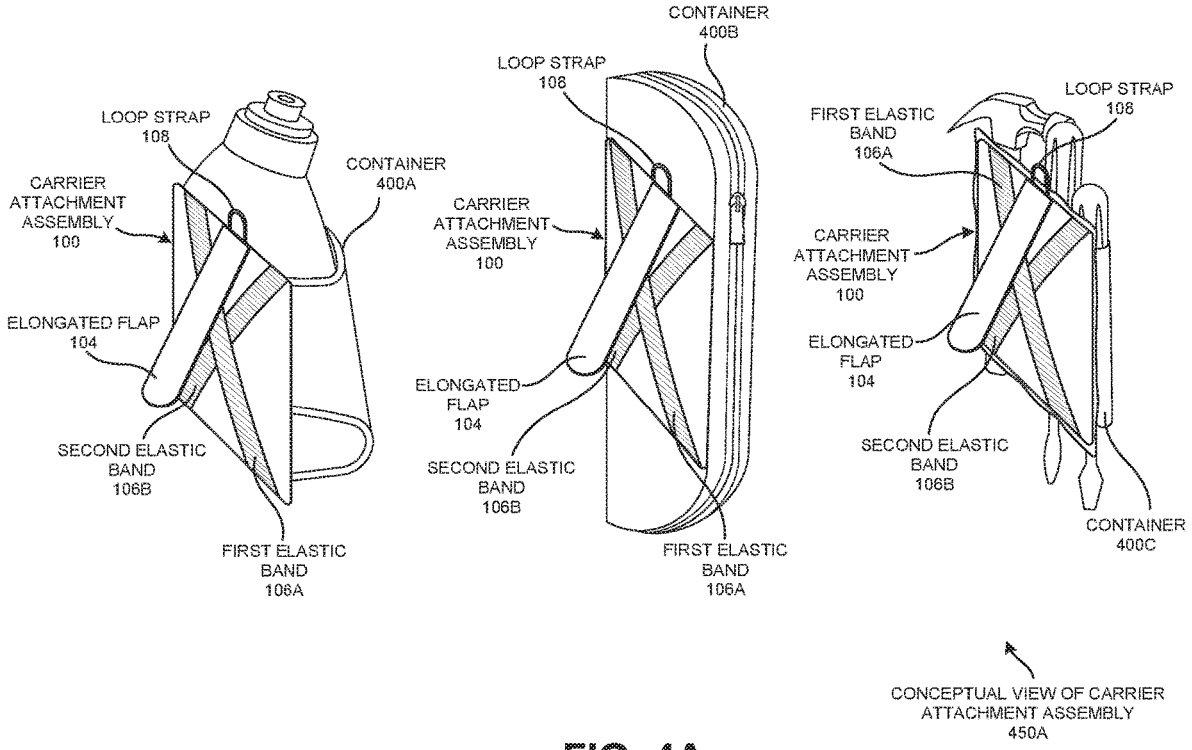
FIG. 4A is a conceptual view of the carrier attachment assembly of FIG. 1 coupled with a plurality of containers, according to one embodiment.

FIG. 4A is a conceptual view of the carrier attachment assembly 450A of FIG. 1 coupled with a plurality of containers (e.g., container 400A, container 400B, and container 400C), according to one embodiment. Particularly, FIG. 4 illustrates a container 400A, a container 400B, and a container 400C, according to one embodiment.

The container 400A may be a bottle holder coupled with the carrier attachment assembly 100 to enable the wearer 200 to carry a bottle container to provide instant access to the bottle container with unrestricted mobility. The container 400B may be a small case coupled with the carrier attachment assembly 100 to enable the wearer 200 to carry a plurality of valuable items to provide instant access to it with unrestricted mobility, according to one embodiment.

The container 400C may be a tool holder coupled with the carrier attachment assembly 100 to enable the wearer 200 to carry a plurality of working tools to provide instant access to it with unrestricted mobility. The container 400A, the container 400B, and the container 400C may be tucked in the inner side of the wearer's garment 202 and/or securely positioned on the arm 201 of the wearer 200, according to one embodiment.

Figure 4B:
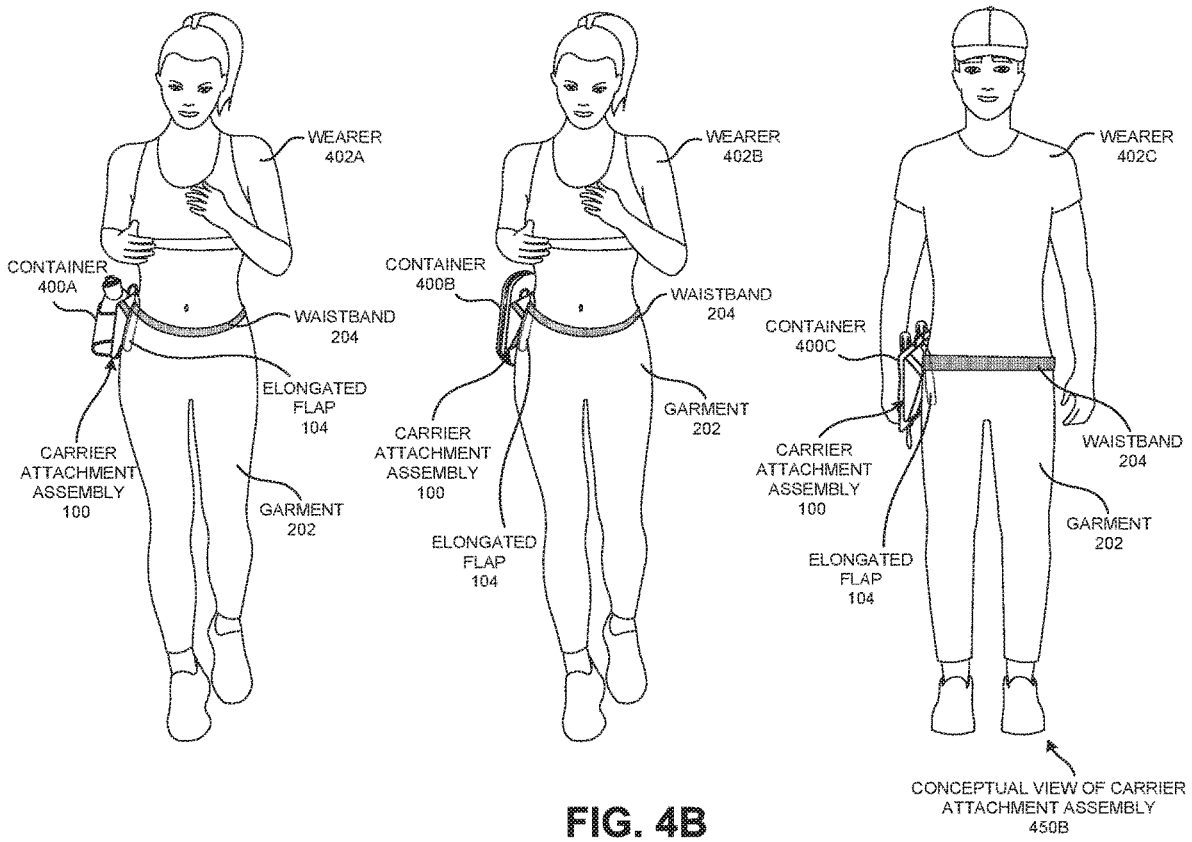
FIG. 4B is a conceptual view of the carrier attachment assembly of FIG. 1 coupled with the plurality of containers to hold the containers onto the wearer's garment to provide instant access to the articles in the container, according to one embodiment.

FIG. 4B is a conceptual view of the carrier attachment assembly 450B of FIG. 1 coupled with the plurality of containers (e.g., container 400A, container 400B, and container 400C) to hold the containers (e.g., container 400A, container 400B, and container 400C) onto the wearer's garment 202 to provide instant access to the articles in the containers (e.g., container 400A, container 400B, and container 400C), according to one embodiment. Particularly, FIG. 4B illustrates a wearer 402A, a wearer 402B, and a wearer 402C, according to one embodiment.

The wearer 402A, 402B, and 402C may be a person carrying a plurality of articles in the container 400A, 400B, and 400C respectively. The wearer 402A, 402B, and 402C may carry a plurality of valuable items in the container 400A, 400B, and 400C respectively on the garment 202 and/or the arm 201. The wearer 402A, 402B, and 402C may have instant access to the articles in the container 400A, 400B and 400C respectively tucked in the inner side of the wearer's garment 202 and/or securely positioned on the arm 201 of the wearer 402A, 402B, and 402C with unrestricted mobility, according to one embodiment.

An example embodiment will now be described. John Doe may be a businessman in New York City having his business spread all over the world. John may need to carry his cell phone constantly to communicate with his executives and clients from different countries. John may also be a fitness fanatic person exercising daily for keeping himself fit. John may need to carry his cell phone and other valuable belongings while exercising outdoors. John may be carrying his cell phone and valuable belongings in his pockets of the form-fitting garment while exercising. However, the disturbing movement of the cell phone in the pockets may be restricting John's free and comfortable body movement. Further, John may not leave his belongings at his home as there may be a chance of missing important phone calls and/or a meeting.

John Doe may have been advised by his friend to carry his valuable belongings in a container 102 as described in the various embodiments of FIGS. 1-4 while exercising outdoors. The multiple attachability options of the container 102 as described in the various embodiments of FIGS. 1-4 may enable John to carry his valuable belongings while exercising without restricting his free and comfortable body movement. The carrier attachment assembly 100 coupled with the container 102 as described in the various embodiments of FIGS. 1-4 may enable John to tuck the container 102 on his garment 202 and/or securely position on his arm 201.

John may tuck an elongated flap 104 of the carrier attachment assembly 100 coupled with the container 102 in the inner side of his garment 202 to securely fit the container 102 on to garment 202. John may position the container 102 coupled with the carrier attachment assembly 100 on an arm attachment position by manipulating the elastic bands (e.g., first elastic band 106A and second elastic band 106B) to insert his hand.

John may now have instant access to the valuable belongings in the container 102 as described in the various embodiments of FIGS. 1-4. The container 102 coupled with the carrier attachment assembly 100 as described in the various embodiments of FIGS. 1-4 may have helped John to carry his belonging while exercising without restricting body movement and attend important business calls.

Although the present embodiments have been described with reference to specific example embodiments, it will be evident that various modifications and changes may be made to these embodiments without departing from the broader spirit and scope of the various embodiments. For example, the various devices and modules described herein may be enabled and operated using hardware circuitry (e.g., CMOS based logic circuitry), firmware, software or any combination of hardware, firmware, and software (e.g., embodied in a non-transitory machine-readable medium). For example, the various electrical structure and methods may be embodied using transistors, logic gates, and electrical circuits (e.g., application specific integrated (ASIC) circuitry and/or Digital Signal Processor (DSP) circuitry).

In addition, it will be appreciated that the various operations, processes and methods disclosed herein may be embodied in a non-transitory machine-readable medium and/or a machine-accessible medium compatible with a data processing system (e.g., data processing device 100). Accordingly, the specification and drawings are to be regarded in an illustrative rather than a restrictive sense.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A carrier attachment assembly, comprising:

an elongated flap having a length between 3 inches and 8 inches and having a proximal end and a distal end, wherein the proximal end is attached to a container coupled with the carrier attachment assembly, and wherein the distal end curves such that the distal end fits between a waist of a wearer and a waistband of a garment worn by the wearer;

a first elastic band at an upper-left corner of the carrier attachment assembly extending across the elongated flap to a lower-right corner of the carrier attachment assembly; and a second elastic band at an upper-right corner of the carrier attachment assembly extending across the elongated flap to a lower-left corner of the carrier attachment assembly, wherein the first elastic band and the second elastic band form an 'X' shape over the elongated flap when positioned in an arm attachment position on an arm of the wearer, wherein the first elastic band and the second elastic band form an 'X' shape under the elongated flap when positioned in a waist attachment position on the waist of the wearer, wherein the elongated flap is movable outside the first elastic band and the second elastic band in accordance with the wearer manipulating any one of the first elastic band, the second elastic band, and the elongated flap to attach the container coupled with the carrier attachment assembly on the waist of the wearer, and wherein the elongated flap is movable inside the first elastic band and the second elastic band in accordance with the wearer manipulating any one of the first elastic band, the second elastic band, and the elongated flap to attach the container coupled with the carrier attachment assembly on the arm of the wearer.

2. The carrier attachment assembly of claim 1, wherein the container is detachable from the carrier attachment assembly.

3. The carrier attachment assembly of claim 1, wherein the container and the carrier attachment assembly are inseparable.

4. The carrier attachment assembly of claim 1, wherein the container is any one of a small carrying case, a smartphone carrier, a rigid container, a flexible container, an item retainer, a mini-purse, a keyholder, a bottle, a liquid holder, a medicine holder, a tool holder, a reading glasses and sunglasses case, a plastic container, a bag, and a mini-pack.

5. The carrier attachment assembly of claim 4, wherein the mini-pack imitates a physical form of a backpack.

6. The carrier attachment assembly of claim 4, wherein the smartphone carrier form of the container includes a first port opening to permit a headphone jack to be exposed to enable the wearer to couple a headphone to a smartphone inside the smartphone carrier.

7. The carrier attachment assembly of claim 6, wherein the smartphone carrier form of the container further includes a second port opening to permit a charging port to be exposed to enable the wearer to couple a charging cable to the smartphone inside the smartphone carrier.

8. The carrier attachment assembly of claim 6, wherein the smartphone carrier form of the container further includes a storage space for at least one of a portable charger and a battery.

9. A method of a carrier attachment assembly coupled with a container to tuck in an inner side of a garment of a wearer comprising:

manipulating at least one of a first elastic band and a second elastic band of the carrier attachment assembly to enable a free movement of an elongated flap from a distal end;

extracting the elongated flap of the carrier attachment assembly in an outward direction such that the first elastic band and the second elastic band form an 'X' shape under the elongated flap;

outstretching a waistband of the garment worn by the wearer to position the container on a waist attachment position of the wearer;

tuck the elongated flap in the inner side of the garment to enable the wearer to access the container; and releasing the waistband to hold the elongated flap of the carrier attachment assembly to fit in the inner side of the garment to hold the container onto the garment, wherein the carrier attachment assembly is detachable from the container.

10. The method of the carrier attachment assembly coupled with the container of claim 9, further comprising:

manipulating the at least one of the first elastic band and the second elastic band of the carrier attachment assembly to position the elongated flap under the first elastic band and the second elastic band; and moving the elongated flap behind the first elastic band and the second elastic band such that the first elastic band and the second elastic band form an 'X' shape over the elongated flap.

11. The method of the carrier attachment assembly coupled with the container of claim 10, further comprising manipulating the first elastic band and the second elastic band of the carrier attachment assembly to enable the wearer to insert a hand thereof.

12. The method of the carrier attachment assembly coupled with the container of claim 11, further comprising positioning the carrier attachment assembly coupled with the container onto an arm attachment position to comfortably fit an arm of the wearer by adjusting thereto.

13. The method of the carrier attachment assembly coupled with the container of claim 9, wherein the container is any one of a small carrying case, a smartphone carrier, a rigid container, a flexible container, an item retainer, a mini-purse, a keyholder, a bottle, a liquid holder, a medicine holder, a tool holder, a reading glasses and sunglasses case, a plastic container, a bag, and a mini-pack.

* * * * *